United States Patent [19]

Hood

[11] Patent Number: 4,506,841

[45] Date of Patent: Mar. 26, 1985

[54] ARBOR FOR A STRIP ACCUMULATOR

[75] Inventor: Walter J. Hood, Shaker Heights, Ohio

[73] Assignee: Kent Corporation, Cleveland, Ohio

[21] Appl. No.: 428,131

[22] Filed: Sep. 29, 1982

[51] Int. Cl.[3] ..... B65H 17/32; B65H 17/48

[52] U.S. Cl. ..... 242/55; 242/55.19 R; 226/97

[58] Field of Search ..... 226/97, 7, 95; 242/78.1, 55.17, 55.18, 55.19 R, 55.16, 179, 55

[56] References Cited

U.S. PATENT DOCUMENTS

| | | | |
|---|---|---|---|
| 3,290,795 | 12/1966 | Jarreby | 226/97 X |
| 3,506,210 | 4/1970 | La Tour et al. | 242/55.19 R |
| 3,782,662 | 1/1974 | Miller | 242/78.1 X |
| 3,885,748 | 5/1975 | Costello et al. | 242/55.19 R X |
| 4,091,979 | 5/1978 | Browder | 226/7 |
| 4,336,900 | 6/1982 | Pontoni | 226/97 |

OTHER PUBLICATIONS

IBM Technical Disclosure Bulletin, vol. 16, No. 11, Apr. 1974, p. 3494.

IBM Technical Disclosure Bulletin, vol. 17, No. 11, Sep. 1974, p. 966.

*Primary Examiner*—Stuart S. Levy

*Assistant Examiner*—Leo J. Peters

*Attorney, Agent, or Firm*—Renner, Kenner, Greive & Bobak

[57] ABSTRACT

An arbor (28) for a strip accumulator (10) includes a hollow generally cylindrical body having an outer curved surface (60) and closed ends (62, 64). The curved surface (60) is provided with a plurality of apertures (82) arranged in a helical pattern around the curved surface (60). Air under pressure is provided to the inside of the arbor (28) and passes through the apertures (82) to support strip material (S) as it travels around the arbor (28) on the helical path.

7 Claims, 5 Drawing Figures

ARBOR FOR A STRIP ACCUMULATOR

TECHNICAL FIELD

This invention relates to an arbor for a strip accumulator which is used in a continuous strip material processing line. More particularly, this invention relates to an arbor around which strip material passes on an air film support.

BACKGROUND ART

In an industrial processing line which utilizes strip material as an input, strip accumulators are often employed to render the process continuous. Thus, a strip accumulator, such as that shown in U.S. Pat. No. 3,506,210, receives strip material from an input coil and holds or stores a quantity of the same while at the same time paying out strip so held to the processing line. In this manner when the input coil is depleted the processing line may remain active utilizing strip from the accumulator while the leading edge of a new input coil is being attached to the trailing edge of the depleted coil.

Many strip accumulators utilize a take-out arbor around which the strip travels as it is leaving the accumulator. An example of such an arbor is shown in U.S. Pat. No. 3,885,748 wherein the arbor is angularly adjustable to maintain the center line of the strip in line with the processing equipment. U.S. Pat. No. 3,885,748 also discloses a plurality of rollers mounted on the arbor forming a helical path for the strip material to pass thereover. The resultant tracking of the strip material is affected by twisting and the angles at which both the arbor and the rollers are mounted. While the device of said patent is entirely acceptable for many widths of strip material, because the rollers are permanently mounted, the angle thereof cannot be adjusted for strip materials of different widths.

Furthermore, the device of U.S. Pat. No. 3,885,748 is limited as to the thickness and physical strength of the strip material with which it may operate. Each idler roller provides some resistance to strip movement as a result of friction between the journal bearing and the axle. Thus, a portion of the force required to pull the strip from the accumulator must be used to overcome this friction. With strips of very low yield strength, the force required to pull the strip around the arbor might well exceed the yield strength of the material. Moreover, these light gauge or soft materials might often be scratched or deformed by contact with the rollers.

Thus, the prior art of which I am aware does not provide a universally acceptable arbor which will handle, without deformation, strip materials of varying widths, hardnesses and physical strengths.

DISCLOSURE OF THE INVENTION

It is thus a primary object of the present invention to provide a strip accumulator with an arbor which will handle varying types and widths of strip material without causing damage thereto.

It is another object of the present invention to provide a strip accumulator with an arbor, as above, which provides support for the strip in its helical path with minimal frictional resistance.

It is a further object of the present invention to provide a strip accumulator with an arbor, as above, which provides continuous strip support over its entire width within the helical path.

It is yet another object of the present invention to provide a strip accumulator with an arbor, as above, which can be adjusted to provide different helical paths for strip materials of different widths.

These and other objects of the present invention, which will become apparent from the description to follow, are accomplished by the improvements hereinafter described and claimed.

In general, the arbor according to the present invention includes a hollow generally cylindrical body having a curved surface and closed ends. The curved surface is provided with a plurality of apertures arranged in a helical pattern around the cylindrical body. Air under pressure is provided to the inside of the cylindrical body and passes through the apertures to support strip material as it travels around the arbor on the helical path.

PREFERRED EMBODIMENT FOR CARRYING OUT THE INVENTION

Figure 1:
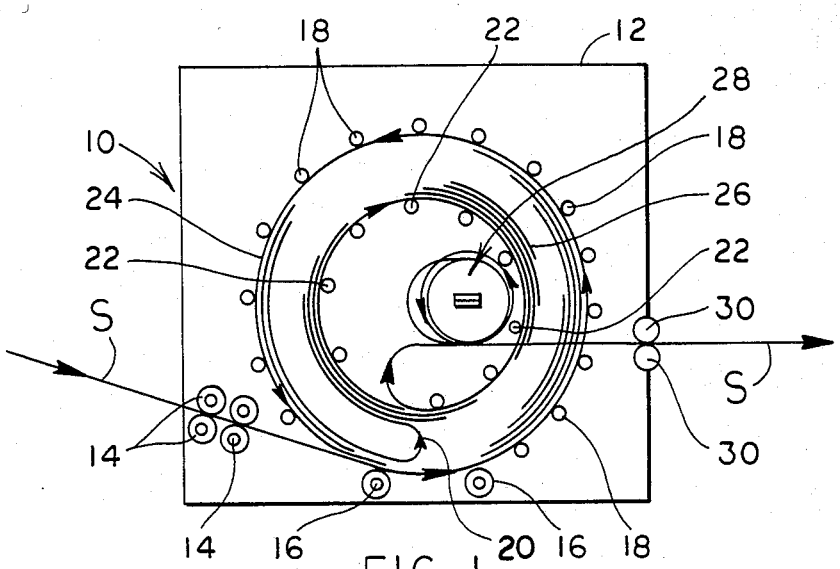
FIG. 1 is a schematic elevational view of a strip accumulator employing an arbor according to the concept of the present invention.

A strip accumulator having the novel features according to the concepts of the present invention is schematically shown in FIG. 1 and indicated generally by the numeral 10. In its preferred form accumulator 10 is of the type shown in detail in U.S. Pat. No. 3,506,210, to which reference is made for whatever details might be necessary to fully understand the environment of the present invention. However, it should be appreciated that the invention described herein may well be utilized in other types of strips handling and procesing devices, all of which are well known in the art.

Accumulator 10 receives strip S, which may be of any material and gauge, but which is generally a metallic material, from an uncoiler (not shown) which carries a coil of strip S. Accumulator 10 includes a frame or face plate 12 which in its preferred form is generally vertically oriented, but which could be tilted or even horizontally oriented, to carry the remaining elements of accumulator 10. A plurality of drive wheels 14, when activated, pull strip S from the uncoiler and into the accumulator. The strip is transferred past guide rollers 16, which may also be driven or which may be driven instead of rollers 14, to form an outer coil of strip material, the outer edge of which is defined by outer basket rollers 18. The strip S travels within the constraints of the outer basket rollers 18 and forms a free loop 20 as it turns to form an inner coil of strip material, the inner edge of which is defined by inner basket rollers 22. In order to perform its storing function, strip S is fed to accumulator 10 faster than it is payed out to the processing line. By so doing, outer convolutions 24 of strip S are accumulated with strip being fed to the outside thereof, and inner convolutions 26 of strip S are accumulated by receiving strip from the inside of outer convolutions 24 by means of the orbiting of loop 20. Upon demand from the processing line the strip on the inside of inner convolutions 26 is transferred around a take-out arbor, generally indicated by the numeral 28, and guided by rollers 30 to the processing line.

One of the primary functions of arbor 28 is to assure that the strip S, no matter what the width, is properly centered on line with the processing equipment. Normally strip S is fed to accumulator 10 with one of its edges being guided and because arbor 28 is mounted at an angle with respect to frame 12, strip S will leave the accumulator centered. In order to accommodate strips of different widths, the angle of axis of arbor 28 with respect to frame 12 is adjustable. One form of this adjustment feature is shown in detail in U.S. Pat. No. 3,885,748, to which reference is made for whatever details might be necessary to understand the adjustable feature of arbor 28, and a simpler form is schematically shown herein in FIG. 2. A bracket 32 affixed to frame 12 receives a clevis 34 mounted on arbor 28. Arbor 28 is thereby pivotable about pin 36 extending through clevis 34 and bracket 32. The other axial end of arbor 28 is provided with an angle adjustment assembly indicated generally by the numeral 38. A plate 40 is carried by structural framework (not shown) of accumulator 10 and carries a bolt 42. A bearing block 44 is mounted on arbor 28 and is slotted, as at 46, which slot receives bolt 42 therethrough. Slot 46 is wider than the diameter of bolt 42 so that bolt 42 may move arcuately therein as the angle of arbor 28 is adjusted. Adjusting bolts 48 and 50 are received through plates 52 and 54, respectively, and bear against block 44. Lock nuts 56 and 58 hold bolts 48 and 50, respectively, in place once the desired angle of arbor 28 is established. It should be evident that by loosening and/or tightening bolts 48 and 50, block 44 may be moved thereby rotating arbor 28 about pin 36.

Arbor 28 is shown as being generally cylindrically shaped having a curved outer surface generally indicated by the numeral 60 and generally planar closed ends 62 and 64. Air under pressure is provided from a conventional high volume, low pressure blower (not shown) via hose or tube 66 through end 64 which thus renders the inside of arbor 28 a plenum chamber 68. The inside of arbor 28 includes an inner cylindrical body member 70, preferably made of a metallic material, having a plurality of relatively large holes 72 uniformly spaced around the circumference thereof. A metal cylindrical cover 74 is affixed to inner cylindrical body member 70 with spacers (not shown) therebetween to form a secondary annular plenum chamber 76 near the outer surface of arbor 28. Chamber 76 not only serves to evenly distribute air at the surface of arbor 28 but also the existence of the cover 74 spaced from body member 70 permits facile replacement of cover 74 when necessary as will hereinafter become evident.

An outer sheath 78 is affixed to cover 74 and actually constitutes the curved outer surface of arbor 28 generally indicated by the numeral 60. Sheath 78 is preferably made of a low friction plastic material to prevent damage to the strip S should it at any time come into contact with sheath 78. Both cover 74 and sheath 78 are provided with aligned apertures 80 and 82 respectively. Although the precise size of apertures 80 and 82 is not critical, it has been found with apertures 80 of a diameter of approximately 1/16 inch and with apertures 82 of a diameter of approximately ¼ inch, satisfactory results will be obtained. By having slightly larger apertures in sheath 78, apertures 82 of sheath 78 can be readily aligned with apertures 80 of cover 74 during the assembly process while maintaining the pressurizing effects of the smaller apertures 80.

Figure 2:
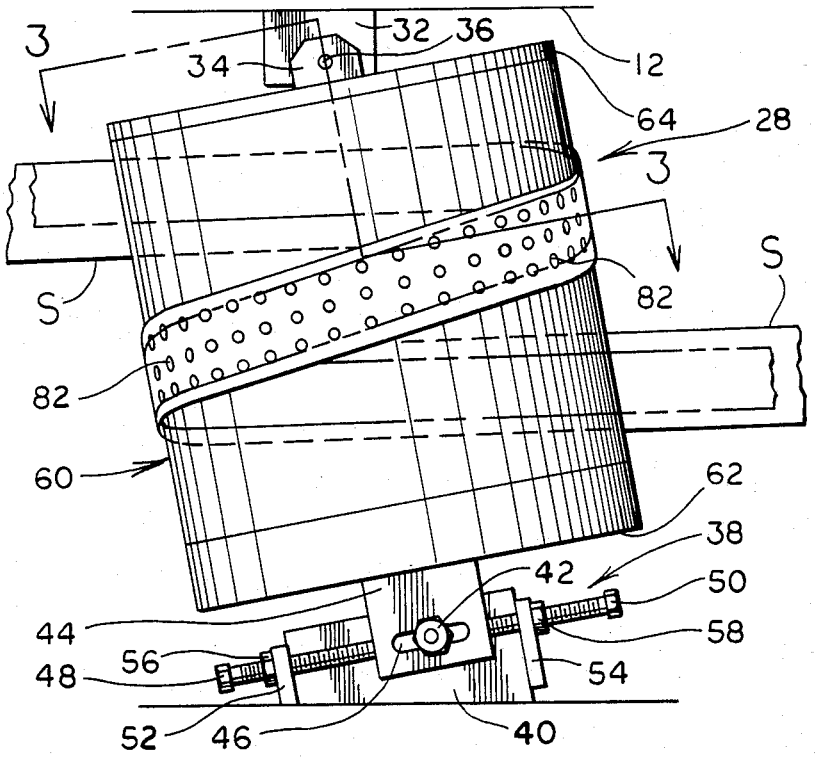
FIG. 2 is a somewhat schematic top plan view of the arbor according to the concept of the present invention showing its use with two strips of differing widths and with some of the details thereof being omitted for clarity.
Figure 3:
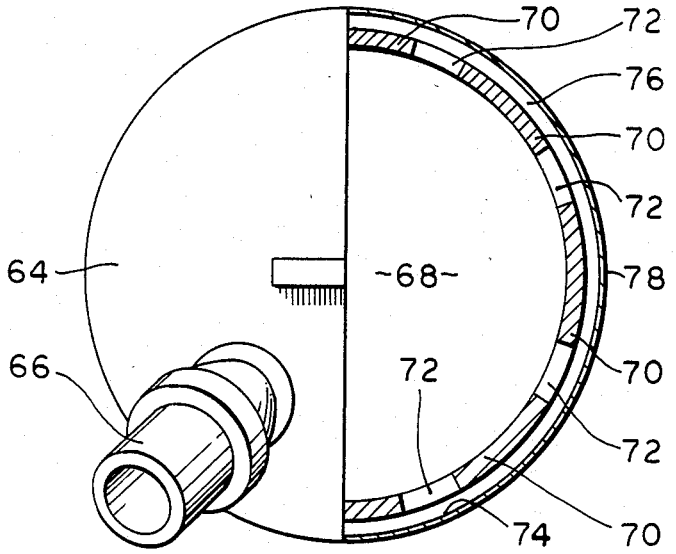
FIG. 3 is a sectional view taken substantially along line 3—3 of FIG. 2.
Figure 4:
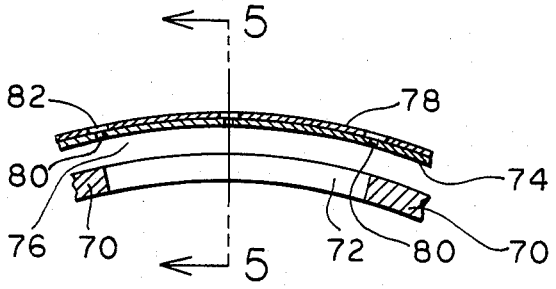
FIG. 4 is an enlarged fragmentary sectional view of a portion of the sectional view of FIG. 3.

As shown in FIG. 2, apertures 80 and 82 are arranged on the outer surface of arbor 28 to approximate the desired helical path of strip S for the widest of strips intended to be processed. Thus, as shown in FIG. 5, as strip S travels around arbor 28, air escaping through apertures 80 and 82 from chamber 76 creates a pressurized air film 84 trapped below strip S so that the strip essentially floats around arbor 28 undamaged.

Figure 5:
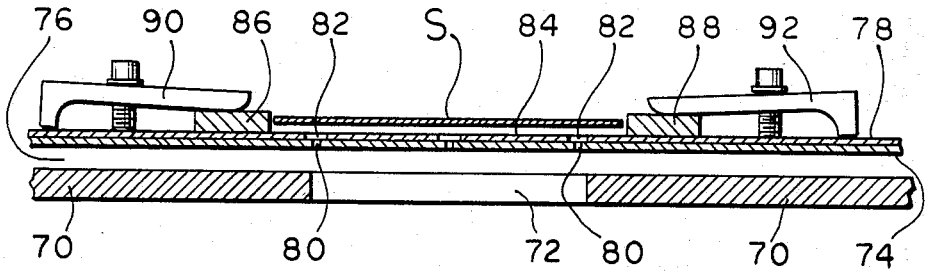
FIG. 5 is a sectional view taken substantially along line 5—5 of FIG. 4.

As also is shown in FIG. 5 (but not in FIG. 1 for clarity) two strip edge guides 86 and 88 are helically and adjustably positioned adjacent the edges of the strip S being processed and held in place by clamps 90 and 92 respectively. Edge guides 86 and 88 are preferably made of a plastic material and serve to define the helical path for strip S and otherwise prevent the strip from straying off its intended path, as might occur when the tension on strip S is relieved. Additionally, edge guides 86 and 88 form a barrier to air flow from film 84 along the edges of the strip. This reduces the power requirements for the air supply and helps to maintain an ideal air film of from 0.002 to 0.010 inch at an air pressure of from 1 to 3 p.s.i. gauge. These values are approximate and will, of course, vary somewhat dependent on the tension placed on strip S as it is pulled through its helical path.

Edge guides 86 and 88 also serve the additional function of covering unneeded apertures 80 and 82 in instances where strip is being processed which is narrower than the maximum width helical path of apertures 80 and 82 provided in the outer surface of arbor 28. Also, as previously indicated, should it be desired to alter the helical path or provide an air film for a strip wider than anticipated, cover 74 and sheath 78 can be easily removed and replaced with apertures of the desired helical configuration or strip width.

It should thus be evident that an accumulator constructed with an arbor according to the invention herein will substantially improve the art and otherwise accomplish the objects of the invention.

I claim:

1. An arbor for a device which accumulates strip material comprising a hollow generally cylindrical member having a curved surface and closed ends, said curved surface including an outer plastic sheath, means to provide air under pressure to the inside of said hollow cylindrical member, a plurality of apertures in said plastic sheath, said apertures being arranged helically around the curved surface of said cylindrical member to permit air to pass therethrough to support the strip material as it passes thereover, a curved metallic cover underneath said plastic sheath, said cover having apertures therein aligned with the apertures in said sheath, and an inner curved body member spaced from said metallic cover and forming a plenum chamber with said metallic cover.

2. An arbor according to claim 1 further comprising means on said curved surface to guide the strip material around said cylindrical member.

3. An arbor according to claim 2, wherein said means to guide includes two guide strips helically positioned around said cylindrical member, one of said guide strips being on each side of the strip material.

4. An arbor according to claim 3, wherein said guide strips are adapted to selectively cover some of said apertures in said curved surface and are closely adjacent to the strip material to enclose with the strip material an air film under the strip material.

5. An arbor according to claim 1 wherein said apertures in said sheath are larger than said apertures in said cover.

6. An arbor according to claim 1 further comprising a plurality of holes in said body member permitting air to pass from the inside of said hollow cylindrical member to said plenum chamber, said holes being substantially larger than the apertures in said sheath and said cover.

7. An arbor according to claim 1 wherein the axis of said cylindrical member is adjustable with respect to the path of the strip material.

* * * * *